US005997315A

United States Patent [19]

Akama et al.

[11] Patent Number: 5,997,315

[45] **Date of Patent: *Dec. 7, 1999**

[54] CONNECTOR AND IC CARD CONNECTOR

[75] Inventors: Junichi Akama, Chigasaki; Hideo Miyazawa, Yokohama, both of Japan

[73] Assignee: Fujitsu Takamisawa Component Limited, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/805,744

[22] Filed: Feb. 25, 1997

[30] Foreign Application Priority Data

Sep. 17, 1996 [JP] Japan ..... 8-245018

[51] Int. Cl.[6] ..... H01R 9/09

[52] U.S. Cl. ..... 439/66; 439/862; 439/326

[58] Field of Search ..... 439/66, 326, 331, 439/376, 71, 862, 751, 733.1

[56] References Cited

U.S. PATENT DOCUMENTS

| | | | |
|---|---|---|---|
| 3,951,491 | 4/1976 | Mysiak | 439/71 |
| 3,960,424 | 6/1976 | Weisenburger | 439/66 |
| 4,008,938 | 2/1977 | Anhalt et al. | 439/71 |
| 4,664,458 | 5/1987 | Worth | 439/66 |
| 5,358,411 | 10/1994 | Mroczkowski et al. | 439/66 |
| 5,567,185 | 10/1996 | Henderson et al. | 439/751 |
| 5,820,388 | 10/1998 | Walden | 439/751 |

FOREIGN PATENT DOCUMENTS

| | | | |
|---|---|---|---|
| 2234961 | 4/1973 | Germany | 439/66 |

OTHER PUBLICATIONS

Becon Connector; "Becon 180° Single 10," Dec., 1961; Brown Eng. Co., Part No. 2802–01.

*Primary Examiner*—Paula Bradley
*Assistant Examiner*—Tho D. Ta
*Attorney, Agent, or Firm*—Staas & Halsey LLP

[57] ABSTRACT

A connector which connects an IC card to a corresponding information input/output unit without cable and can be removed as needed has a structure in which a plurality of U-shaped conductive pieces formed of a sheet metal are fixed to a rectangular-rod-like insulating block. Each conductive piece has a central portion fixed to a corresponding notched portion formed in a side surface of the insulating block, a first contact portion extending from the central portion in one direction and bent at an almost right angle along the lower surface of the insulating block, and a second contact portion extending from the central portion in an opposite direction, held to be elastically deformed in a groove formed in the upper surface of the insulating block, and including an end portion projecting from the upper surface. As an embodiment, the following structure is disclosed. A pair of projection portions are formed on both the sides of the central portion of the conductive piece, the projection portions are bent so as to form a U shape having a bottom as the central portion, and the bent projection portions are fitted in the respective holes formed in the corresponding notched portion of the insulating block, so as to fix each conductive piece to the insulating block.

11 Claims, 8 Drawing Sheets

CONNECTOR AND IC CARD CONNECTOR

BACKGROUND OF THE INVENTION

1. Field of the Invention

The present invention relates to a connector which can connect pairs of electrodes opposite to each other with a predetermined distance to each other without use of a cable and which can be removed from a portion between the electrodes as needed. More particularly, the invention relates to the structure of a connector for connecting an information input/output electrode arranged on a so-called IC card incorporated with an integrated circuit chip to a corresponding electrode arranged on a baseboard exposed inside an apparatus into which the IC card is mounted during an information inputting/outputting operation.

2. Description of the Related Art

The technical background of the present invention will be described below with reference to FIGS. 6 to 8B. A connector used to satisfy the above object is called an IC card connector hereinafter.

FIG. 6 is a perspective view for explaining an IC card related to a connector to which the present invention is applied and outlines the structure of a reception apparatus into which the IC card is mounted when information is read from and written on the IC card. FIGS. 7A and 7B are perspective views for explaining the structure of a conventional IC card connector. FIGS. 8A and 8B are perspective views for explaining the structure of another conventional IC card connector.

Referring to FIG. 6, an IC card 11 is inserted into an attachment member (to be referred to as a magazine hereinafter) 122 of a reception apparatus 12 in the direction of arrow C, and the IC card 11 is removed in the reverse direction. A window 111*a* is formed in the side surface of an end portion of the IC card 11 in the insertion direction. In the window 111*a*, a plurality of information input/output electrodes 111*b* are exposed in such a state that the information input/output electrodes 111*b* are arranged in a matrix of two rows, for example.

The reception apparatus 12 is constituted by a baseboard 121 fixed to a housing 1 of an information input/output equipment for exchanging information with the IC card 11, and the magazine 122. The magazine 122 is supported such that the magazine 122 can be pivoted in the direction of arrow B about an engagement portion 121*b* at the hinge portion 122*a* arranged on one end portion of the baseboard 121. When the IC card 11 is inserted into the magazine 122, and the magazine 122 is closed by a vertical wall 121*a*, i.e., the magazine 122 is pivoted to be in tight contact with the baseboard 121, and the IC card 11 is held in position in the insertion direction by the vertical wall 121*a*.

In the baseboard 121, an opening 121*c* corresponding to the window 111*a* of the IC card 11 inserted into the magazine 122 and positioned by the vertical wall 121*a* is formed. In the opening 121*c*, connection electrodes 121*d* are formed at positions corresponding to the plurality of information input/output electrodes 111*b* of the IC card 11. The connection electrodes 121*d* are connected to a circuit (not shown) in the housing 1. The magazine 122 has an opening 122*b* corresponding to the opening 121*c* of the baseboard 121.

A hook 121*e* is arranged on the vertical wall 121*a* of the baseboard 121, so that the magazine 122 to which the IC card 11 is inserted is fixed to be in tight contact with the baseboard 121. When the hook 121*e* is released, for example, the magazine 122 is pressed upward by a control rod 121*f* biased by a spring. In this manner, the IC card 11 can be removed.

In the IC card 11, assume that the difference between the level of a surface 111*c* on which the information input/output electrodes 111*b* are formed and the level of a surface 111*d* in which the window 111*a* is formed is represented by $t_1$, that the thickness of the bottom plate of the baseboard 121 of the reception apparatus 12 is represented by $t_2'$, and that the thickness of the side wall of the magazine 122 is represented by $t_2''$. In this case, a gap represented by $t_1+t_2$ is present between the information input/output electrodes 111*b* of the IC card 11 and the connection electrodes 121*d* formed in the opening 121*c* of the baseboard 121. Here, $t_2$ is the sum of $t_2'$ and $t_2''$. For this purpose, a connector is required to connect the information input/output electrodes 111*b* of the IC card 11 to the connection electrodes 121*d* of the baseboard 121. FIGS. 7A and 8B are perspective views for explaining a conventional card connector.

The structure of a conventional IC card connector 2 and connection between the IC card connector 2 and the connection electrodes 121*d* of the corresponding reception apparatus 12 will be described below with reference to FIGS. 7A and 7B. The IC card connector 2 is formed of an insulating rubber material 2*a* and has a size to fit in the opening 121*c* formed in the baseboard 121 of the reception apparatus 12 and a thickness $a_1$ which is slightly larger than the gap $t_1+t_2$. A plurality of conductive columns 2*b* formed of an insulting rubber material are buried in the insulating rubber material 2*a* and are bored through the insulating rubber material 2*a* in the direction of the thickness $a_1$. The conductive columns 2*b* are arranged in correspondence with the information input/output electrodes 111*b* of the IC card 11 (FIG. 6) and the connection electrodes 121*d* of the baseboard 121. Both ends of the conductive columns 2*b* are exposed from the insulating rubber material 2*a*.

The IC card connector 2 is inserted into the opening 121*c* of the baseboard 121 as indicated by arrow D in FIG. 7A, and one exposed end of each conductive column 2*b* is brought into contact with the corresponding connection electrode 121*d*. As described above with reference to FIG. 6, the magazine 122 into which the IC card 11 is inserted is brought into contact with the baseboard 121 and locked by the hook 121*e*. In this state, each information input/output electrode 111*b* of the IC card 11 is brought into contact with the other exposed end of the corresponding conductive column 2*b* of the IC card connector 2. In this manner, the information input/output electrodes 111*b* of the IC card 11 and the connection electrodes 121*d* of the baseboard 121 of the reception apparatus are connected to each other by the conductive columns 2*b*, respectively.

The structure of another conventional IC card connector 3 and connection between the IC card connector 3 and the connection electrodes 121*d* of the corresponding reception apparatus will be described below with reference to FIGS. 8A and 8B. For the same reason as in the prior art, the IC card connector 3 is constituted by an insulating block 31 having a thickness $a_2$ equal to $t_1+t_2$. The insulating block 31 has a notched portion formed in the longitudinal direction of the insulating block 31, and a plurality of contact pieces 32 formed bored through both the side walls of the notched portion. The contact pieces 32 on each of the side walls are arranged at the same pitch as that of the arrangement of the corresponding connection electrodes 121*d* on the baseboard 121 of the reception apparatus 12 and the arrangement of the information input/output electrodes 111*b* of the IC card 11. The contact pieces 32 include contacts 32*a* each having one end portion which is bent into an inverted-U shape and eternal connection terminals 32*b* each having the other end portion which is offset-bent, and a portion between the contact 32*a* and the external connection terminal 32*b* is fixed to the walls. The peak of each contact 32*a* slightly projects from an upper surface 31*b* of the insulating block 31. The external connection terminal 32*b* is on the same plane as that of the lower surface 31*a* of the insulating block 31.

The IC card connector 3 is inserted into the opening 121*c* of the baseboard 121 in a direction indicated by arrow E, and the external connection terminals 32*b* are soldered to the corresponding connection electrodes 121*d* in the opening 121*c*, respectively. In this manner, the contact pieces 32 of the IC card connector 3 are electrically connected to the connection electrodes 121*d* of the baseboard 121. As described above with reference to FIG. 6, the magazine 122 into which the IC card is inserted is brought into tight contact with the baseboard 121, and the IC card is locked by the hook 121*e*. In this state, the information input/output electrodes 111*b* of the IC card 11 are brought into contact with the corresponding contact pieces 32 of the IC card connector 3. In this manner, the information input/output electrodes 111*b* of the IC card 11 are connected to the connection electrodes 121*d* of the baseboard 121, respectively.

SUMMARY OF THE INVENTION

Since the IC card connector 2 described with reference to FIGS. 7A and 7B has a main body consisting of a rubber material, the IC card connector 2 can be fixed to the baseboard 121 of the reception apparatus by using the elasticity of the IC card connector 2. In addition, since the IC card connector 2 is detachable from the baseboard 121, the IC card connector 2 can be easily replaced with another one. However, the rubber material deteriorates after long periods of use, so the elasticity thereof may be eliminated. As a result, the reliability of electrical connection between the information input/output electrodes 111*b* of the IC card 11 and the baseboard 121 of the reception apparatus 12 is disadvantageously degraded.

The IC card connector 3 described with reference to FIGS. 8A and 8B has relatively high reliability in use for a long period of time, but the external connection terminal 32*b* extend outside from the lower surface 31*a* of the insulating block 31. For this reason, the occupied area of the IC card connector 3, i.e., the area of the opening 121*c* formed on the baseboard 121 of the reception apparatus, is large. In other words, when the occupied area of the IC card connector 3 is limited, the planar size of the insulating block 31 must be decreased. As a result, manufacturing, mounting, or replacement of the IC card connector 3 increases in difficulty, and these operations are cumbersome.

Therefore, it is an object of the present invention to provide an IC card connector which is capable of assuring reliable and stable electrical connection in use for long periods of time, and can easily be replaced with a new one.

It is another object of the present invention to provide an IC connector which need not occupy an area larger than that of a conventional IC card connector, and can assure reliable and stable electrical connection for long periods of time.

In order to achieve the above objects, according to the present invention, there is provided an IC card connector which has a plurality of plate-like conductive pieces bent to be respectively connected to opposing electrodes of a plurality of electrode pairs constituted by a pair of first and second electrodes opposite to each other with a predetermined minimum distance, which has an insulating block for fitting the plurality of conductive pieces, and which can be removed from the gap between the opposing electrodes as needed. The insulating block has an upper surface and a lower surface opposing the first and second electrodes of the plurality of electrode pairs respectively, and at least one side surface in which a plurality of notched portions having the plurality of conductive pieces fixed thereto, and each conductive piece has a central portion fixed to the insulating block in a corresponding notched portion, a first contact portion extending from the central portion in one direction and bent so as to stretch along the lower surface, and a second contact portion having an end extending from the central portion in an opposite direction and projecting from the upper surface.

According to the present invention, the connector is used as an IC card connector for connecting the information input/output electrodes of the IC card to the connection terminals of an information input/output unit for exchanging information with the IC card, has connection terminals whose number corresponds that of the information input/output electrodes, and is formed such that the insulating block having these connection terminals has a thickness which is smaller than the distance between the information input/output electrodes and the connection electrodes when the connector is inserted between the information input/output electrodes and the connection electrodes, a first contact portion is brought into contact with the connection electrodes of the IC card information input/output unit, and an end of a second contact portion is brought into contact with the information input/output electrodes of the IC card.

In the present invention, connection terminals each constituted by an elastic plate-like conductive piece which is bent into a "U" shape to cover an insulating rectangular-rod like member are arranged at a predetermined pitch to be fixed, thereby constituting an IC card connector. The conductive pieces are formed such that the end portion of at least one e tending portion of each conductive piece is spaced apart from the insulating block.

The end portions are brought into contact with the information input/output electrode when the IC card connector is inserted between the information input/output electrodes of the IC card and the connection electrodes of the IC card information input/output unit, and the end portions are elastically deformed by receiving a pressure from the information input/output electrodes. The pressure is transmitted to the end portion of the other extending portion of the conductive piece, and the end portions are brought into tight contact with the connection electrodes of the IC card information input/output unit, thereby completing connection between the end portions and the connection electrodes. Therefore, a packaging operation for soldering as in the conventional connector described with reference to FIGS. 8A and 8B is not required. At the same time, an unnecessary increase in planar size caused by the external connection terminals 32*b* does not occur.

Therefore, according to the present invention, a detachable IC connector which can assure reliable and stable electric connection can be provided.

BRIEF DESCRIPTION OF THE DRAWINGS

FIG. 1A is perspective view of the connection as a whole and FIG. 1B is a front view including a partial sectional view when viewed from direction F in FIG. 1A;

DESCRIPTION OF THE PREFERRED EMBODIMENT

Figure 6:
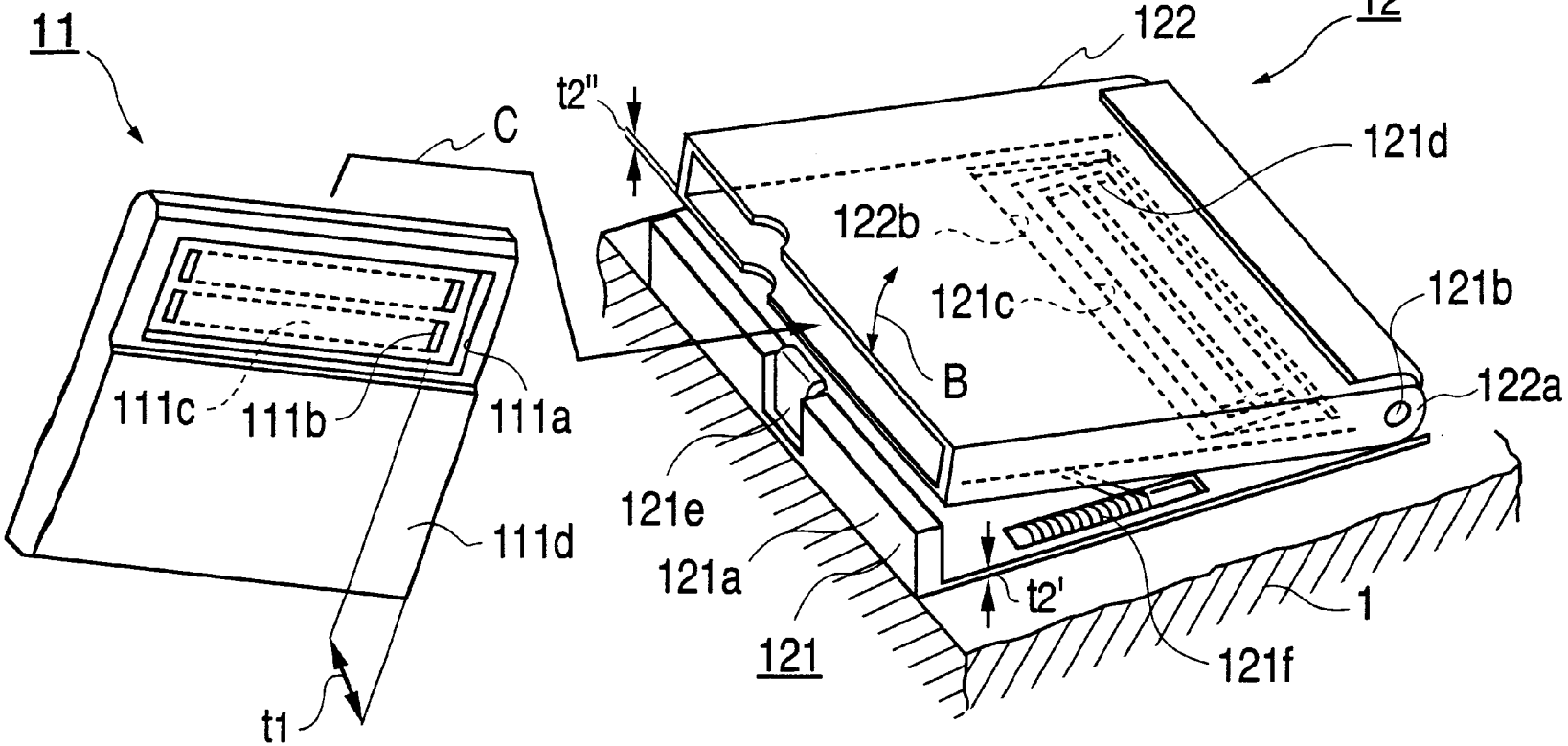
FIG. 6 (PRIOR ART)
FIG. 6 is a view for explaining the technical background of the present invention.

A case wherein a connector according to the present invention is applied to a reception apparatus 12 described with reference to FIG. 6 will be described below as an example. The same reference numerals as in FIG. 6 denote the same parts and members, and a repeat of the description of same will be omitted.

Figure 1A:
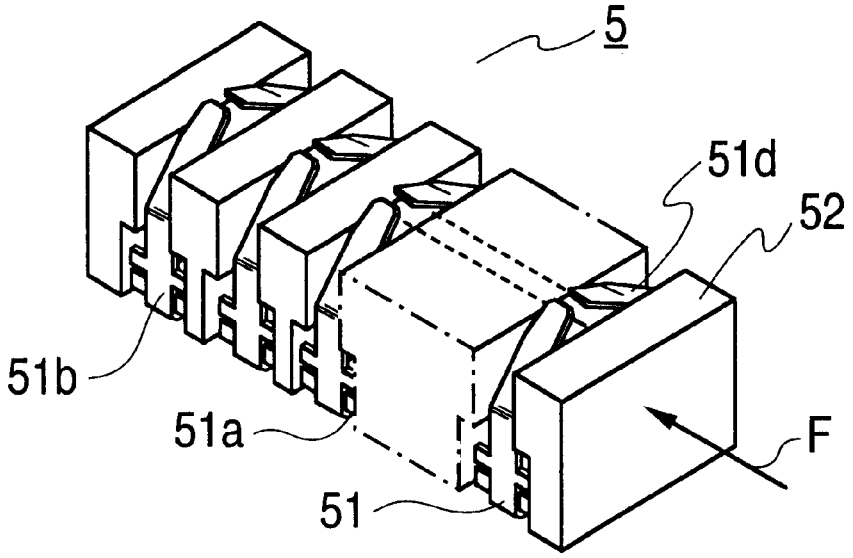
FIGS. 1A and 1B are views, for explaining an embodiment of a connector according to the present invention.
Figure 1B:
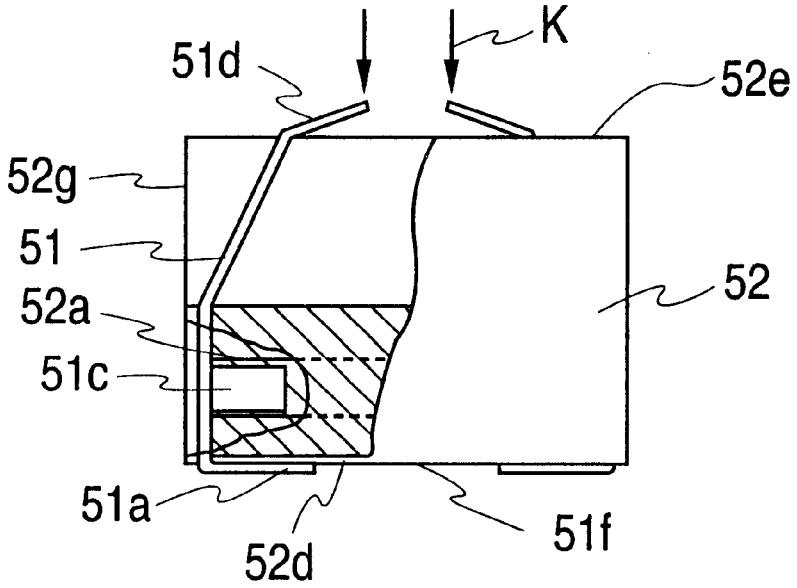

Referring to FIGS. 1A and 1B, a connector 5 according to the present invention comprises a plurality of conductive pieces 51 consisting of an elastic plate-like member and an insulating block 52 to which the conductive pieces 51 are fixed. The conductive pieces 51 are arranged and fixed on at least a side surface of the insulating block 52 at the same pitch as that of the information input/output electrodes 111*b* of the IC card 11 described with reference to FIG. 6 and the connection electrodes 121*d* of the reception apparatus 12. In general, as shown in FIGS. 1A and 1B, a plurality of conductive pieces 51 are fixed on both opposing side surfaces of the insulating block 52, respectively.

Figure 2A:
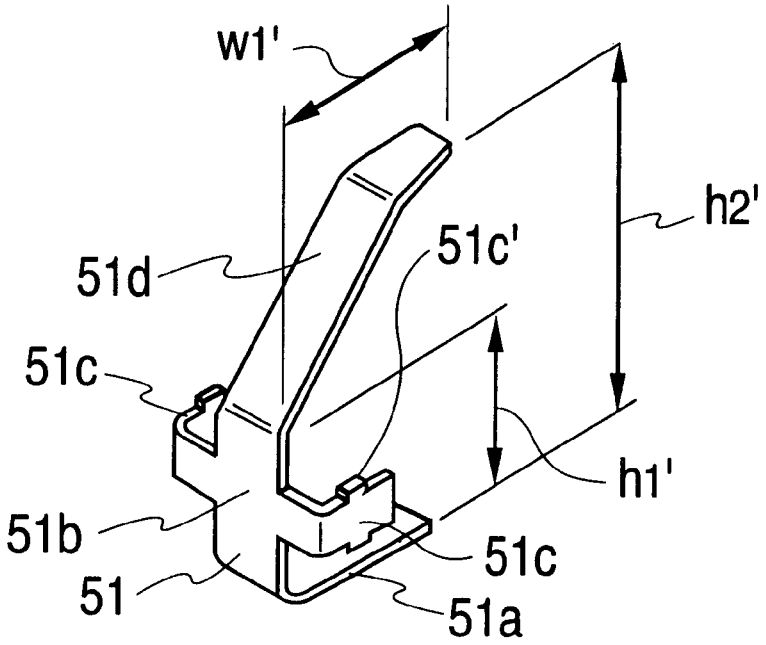
FIGS. 2A and 2B are perspective views for explaining the structure of a conductive piece serving an external terminal of the connector according to the present invention and a method of manufacturing the conductive piece.
Figure 2B:
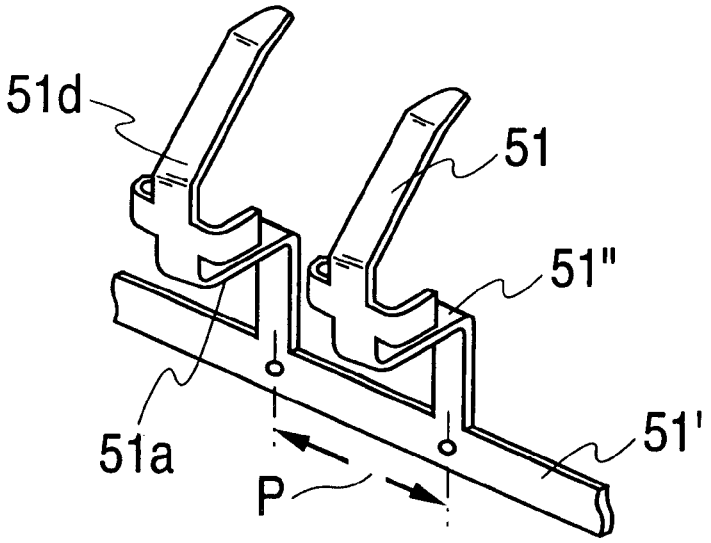

FIG. 2A is a perspective view showing the detail of the structure of one conductive piece 51. FIG. 2B is a view for explaining a method of manufacturing the conductive piece 51.

As shown in FIG. 2A, the conductive piece 51 includes a first contact portion 51*a* to be in contact with the connection electrode 121*d* of the reception apparatus 12, a second conductive portion 51*d* to be in contact with the information input/output electrode 111*b* of the IC card 11, and a central portion 51*b* serving as an intermediate portion for connecting the first contact portion 51*a* to the second conduct portion 51*d* and fixed to the insulating block 52.

Referring to FIGS. 1B and 2A, the first contact portion 51*a* extending from the central portion 51*b* in a direction (downward in the figures) is bent substantially perpendicular to the central portion 51*b* and stretches along the lower surface of the insulating block 52. The second contact portion 51*d* extends from the central portion 51*b* in the direction opposite to the extending direction of the first contact portions 51*a* and is bent at an angle smaller than the right angle in the same direction as that of the first contact portion 51*a*. As a result, the second contact portion 51*d* obliquely extends toward an upper surface 52*e* of the insulating block 52, and its end portion projects from the upper surface 52*e* of the insulating block 52. This end portion is further bent to make an angle larger than that of the main extending portion of the second contact portion with respect to the central portion 51*b*. Although this end portion is illustrated as a planar shape on FIGS. 1B and 2A, the shape of the end portion may be an inverted-U shaped curve.

A pair of projection portions 51*c* which are bent at an almost right angle in a direction perpendicular to the central portion 51*b* are arranged on both sides of the central portion 51*b*. The first contact portion 51*a*, the central portion 51*b*, the projection portion 51*c*, and the second contact portion 51*d* are formed from a sheet metal by using a press processing as will be described later. When the conductive piece 51 is bent, the major surfaces of the respective portions 51*a*–51*d* cross each other. In particular, the surfaces of the first contact portion 51*a*, the central portion 51*b* and the projection portion 51*c* cross each other at almost right angles. Second small projection portions 51*c*' are arranged on both sides of each projection portion 51*c*. The projection portions 51*c* and 51*c*' are means for fixing the conductive piece 51 to the insulating block 52 as will be described later. The projection portions 51*c* and 51*c*' are not necessary when another means is used.

The dimensions of the portions 51*a*–51*d* of the conductive piece will be described below. The length (height set with reference to the first contact portion 51*a*) $h_1'$ of the central portion 51*b* to be fixed to the insulating block 52 is almost equal to or slightly larger than an effective thickness $h_1$ of the side surface of the insulating block 52. A height $h_2'$ of the end portion of the second contact portion 51*d* set with reference to the first contact portion 51*a* is almost equal to a height $h_2''$ (FIG. 8A), from the lower surface 31*a* of the insulating block 31 to the top of the inverted-U shape of the contact 32*a* in the IC card connector 3 described with reference to FIG. 8A. A planar distance $w_1'$ between the central portion 51*b* and the end of the second contact portion 51*d* is set to be almost equal to a planar projection distance $w_1''$ (FIG. 8A), between the distal end of the external connection terminal 32*b* to the top 32*a* of the inverted-U shape in the connector 3 in FIG. 8. In this manner, the connector 5 according to the present invention is fitted in the opening 121*c* formed in the baseboard 121 of the reception apparatus 12, and the conductive piece 51 can be brought into contact with a corresponding connection electrode 121*d* exposed in the opening 121*c*.

FIG. 2B shows the conductive pieces 51 as an intermediate product, in which each of plural conductive pieces 51 is connected to a connection member 51'. Such an intermediate product is fabricated by a continuous press process including punching out a sheet metal and forming the punched-out sheet metal with a press. When a dent for cutting is formed on a boundary 51" between the first contact portion 51*a* and the connection member 51', the respective first contact portions 51*a* can be easily disconnected from the connection member 51'. When the projection portion 51*c* is formed on the central portion 51*b*, an arrangement pitch p of the conductive pieces 51 on the connection member 51' may be limited to the required length of the projection portion 51*c*. At this time, the arrangement pitch p is preferably set to be an integer times the arrangement pitch of the conductive pieces 51 on the insulating block 52.

Figure 3A:
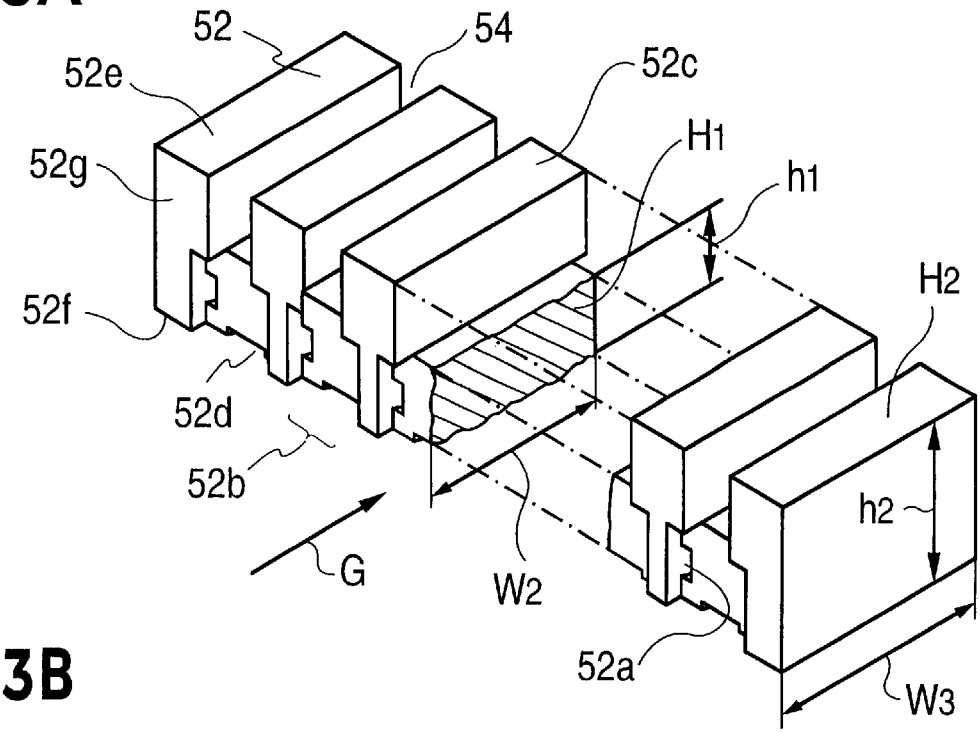
FIGS. 3A and 3B are a perspective view and a front view when viewed from direction G in FIG. 3A, for explaining the structure of an insulating block in the connector according to the present invention.
Figure 3B:
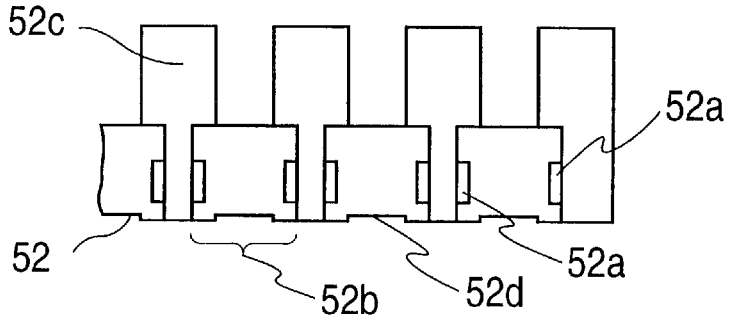

The structure of the insulating block 52 for fixing the conductive piece 51 will be described below with reference to FIGS. 3A and 3B. FIG. 3A is a perspective view showing the entire shape of the structure, and FIG. 3B is a side view showing the structure viewed from a direction indicated by arrow G in FIG. 3A.

Figure 7A:
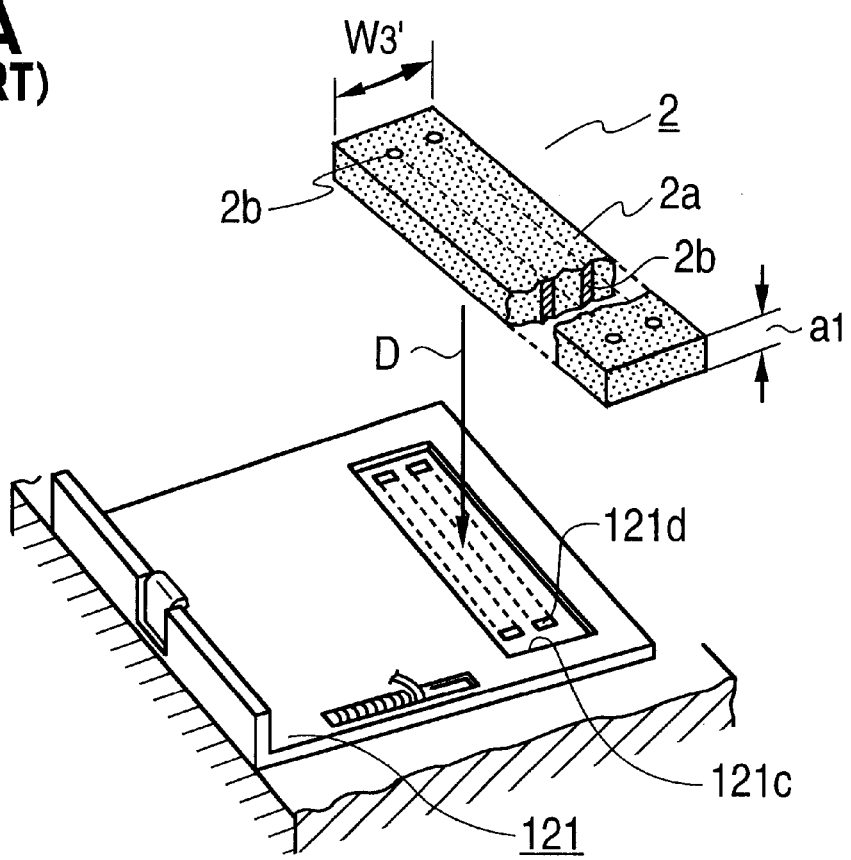
FIG. 7A (PRIOR ART)
FIGS. 7A and 7B are perspective views for explaining the structure of a conventional IC card connector.
Figure 7B:
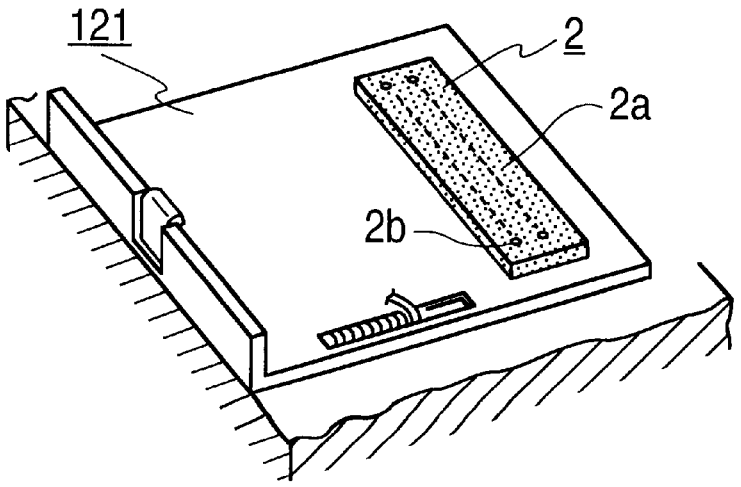
FIG. 7B (PRIOR ART)

The insulating block 52 generally has the upper surface 52*e*, a lower surface 52*f*, and a side surface 52*g* which are generally perpendicular to each other, and is constituted by a rectangular-rod-like member made of a synthetic resin. A height $h_2$ of a section $H_2$ perpendicular to the longitudinal direction of the insulating block 52 is almost equal to a height $a_2$ of the insulating block 31 of the conventional connector 3 shown in FIG. 8A for example. A width $W_3$ of the insulating block 52 is set to be almost equal to a width $w_3'$ of the conventional connector 2 shown in FIG. 7A for example.

A plurality of notched portions 52*b* are formed in the side surface 52*g* of the insulating block 52. Each notched portion 52*b* has a bottom surface crossing the lower surface 52*f*. The depth of the notched portion 52*b*, i.e., the distance from the side surface 52*g* to the bottom surface of the notched portion 52*b*, is almost equal to or slightly larger than the thickness of a plate member constituting the conductive piece 51. The arrangement pitch of the notched portions 52*b* on the side surface 52*g* is equal to the arrangement pitch of the information input/output electrodes 111*b* of the IC card 11 described with reference to FIG. 6 and the connection electrodes 121*d* of the reception apparatus 12.

In each notched portion 52*b*, as shown in FIG. 2, two holes 52*a* on which two projection portions 51*c* arranged on the conductive piece 51 are fitted are formed. The two projection portions 51*c* are inserted into the holes 52*a*, thereby fixing the conductive piece 51 to the insulating block 52. The second projection portions 51*c*' formed on each projection portion 51*c* contributes to an effect of more strongly fixing the conductive piece 51 to the insulating block 52. In the structure in which the conductive pieces 51 are fixed to both side surfaces of the insulating block 52, the holes 52*a* formed in the corresponding notched portion 52*b* on each side surface may be a through hole traversing the insulating block 52. When the conductive piece 51 is fixed to the insulating block 52 with another means, e.g., an adhesive agent or screws, the holes 52*a* need not be formed in the insulating block 52, and, at the same time, the projection portions 51*c* and 51*c*' need not be formed on the conductive piece 51.

A plurality of grooves 54 corresponding to the notched portions 52*b* are formed in the upper surface 52*e* of the insulating block 52. Each groove 54 extends across the side surface of the insulating block 52, and its bottom surface crosses the notched portion 52*b*. Referring to FIG. 3, reference numeral 52*c* denotes a partition portion left between adjacent grooves 54. Inside the groove 54, the second contact portion 51*d* of the conductive piece 51 obliquely extends upward, and its end portion projects from the upper surface 52*e* (see FIG. 1B). When this connector is inserted between the IC card 11 and the reception apparatus 12 described with reference to FIG. 6, the second contact portion 51*d* is brought into contact with and pressed by the corresponding information input/output electrode 111*b* of the IC card 11. As a result, the second contact portion 51*d* is elastically deformed. The groove 54 is a space for allowing the deformed second contact portion 51*d* to move. Therefore, in place of the plurality of grooves 54, one groove shared by the notched portions 52*b* may be used. More specifically, the structure in which only the partition wall present between adjacent grooves 54 is removed may be used. This structure is allowed when the arrangement pitch of the plurality of conductive pieces 51 is relatively large.

As needed, a plurality of second grooves 52*d* corresponding to the conductive pieces 51 may be formed on the lower surface 52*f* of the insulating block 52. Each groove 52*d* has a bottom wall crossing the notched portions 52*b*, and its depth is smaller than the thickness of the first contact portion 51*a*. Therefore, when the conductive piece 51 is fixed to the insulating block 52, the first contact portion 51*a* has a surface which always projects from a lower surface 51*f* of the insulating block 52.

The second grooves 52*d* are effective to position the first contact portions 51*a* when the arrangement pitch of the plurality of conductive pieces 51 is relatively small. Therefore, when the connector is removed from the space between the IC card 11 and the reception apparatus 12, and only the portion of the first contact portion 51*a* near the central portion 51*b* is fitted in the second groove 52*d*, the portion near the distal end of each of the first contact portions 51*a* need not be in tight contact with the lower surface 52*f* of the insulating block 52. When the connector is inserted between the IC card 11 and the reception apparatus 12, the first contact portion 51*a* is entirely fitted in a corresponding groove 52*d*.

Referring to FIG. 3A, reference symbol $h_1$ denotes an effective thickness of the section $H_1$ (hatched portion) of the insulating block 52, and reference symbol $w_2$ denotes the width of the section $H_1$. The effective thickness $h_1$ is almost equal to or slightly smaller than the height $h_1'$ (see FIG. 2A). The width $w_2$ is equal to the width $w_2''$ of the insulating block 31 of the IC card connector 3 shown in FIGS. 8A and 8B.

Figure 4A:
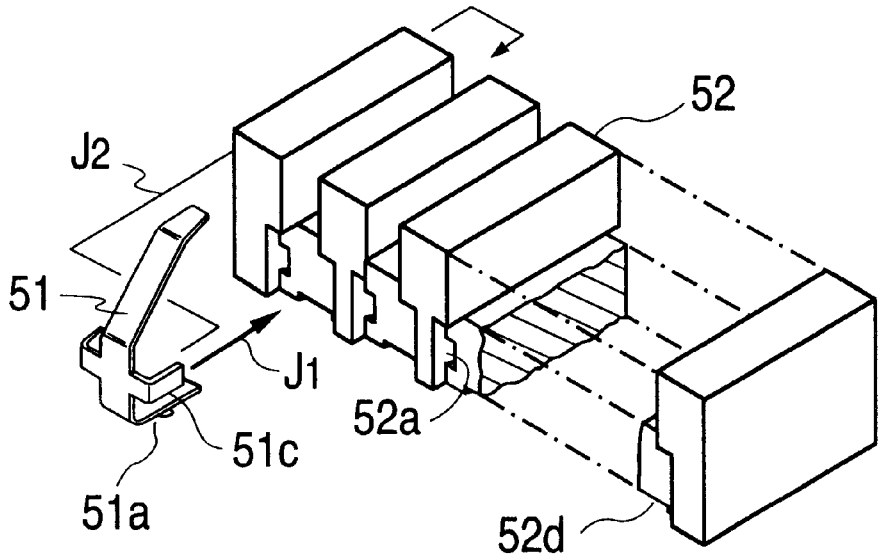
FIGS. 4A and 4B are perspective views for explaining a method of assembling the connector according to the present invention.
Figure 4B:
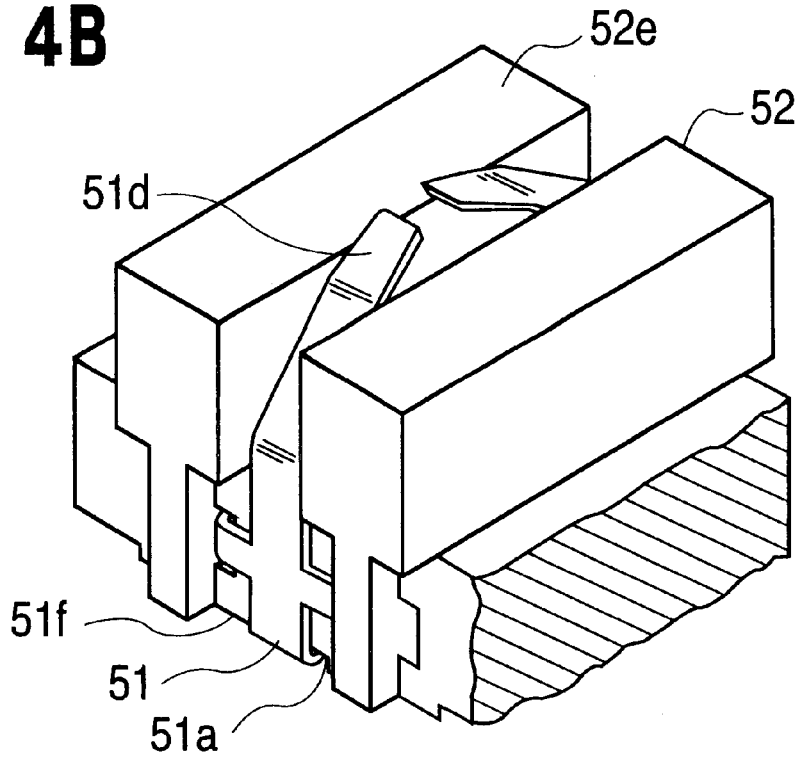

FIGS. 4A and 4B are perspective views for explaining a method of fixing the conductive piece 51 having the projection portions 51*c* to the insulating block 52. FIGS. 4A and 4B show states before and after the projection portion 51*e* of the conductive piece 51 is inserted into the hole 52*a* of the insulating block 52, respectively.

Referring to FIG. 4A, the projection portions 51*c* of the conductive piece 51 described in FIG. 2A are positioned to the holes 52*a* formed in the notched portions 52*b* in the side surfaces 52*g* of the insulating block 52 shown in FIGS. 3A and 3B, and the projection portions 51*c* of the conductive pieces 51 are inserted into the holes 52*a* of the insulating block 52 by pressure in the direction indicated by arrows $J_1$ and $J_2$. In this manner, the conductive pieces 51 are fixed to the insulating block 52. Each conductive piece 51 is more strongly fixed to the insulating block 52 by the second projection portions 51*c*' arranged on a pair of projection portions 51*c* of each conductive piece 51, thereby setting the state shown in FIG. 4B.

In general, the projection portions 51*c* of the plurality of conductive pieces 51 formed on the connection member 51' as shown in FIG. 2B are inserted into the corresponding holes 52*a* to fix the plurality of conductive pieces 51 to the insulating block 52. Thereafter, the connection member 51' is bent at the boundary 51" to be removed from the conductive piece 51. In this manner, manufacturing efficiency is improved. As described above, depending on the length of the projection portion 51*c*, the necessary number of conductive pieces 51 cannot be arranged on a connection member 51' at the same pitch as that of the arrangement pitch of the information input/output electrodes 111*b* of the IC card 11 and the connection electrodes 121*d* (see FIG. 6) of the reception apparatus 12. In this case, for example, the arrangement pitch p of the plurality of conductive pieces 51 formed on the connection member 51' is set to be twice the arrangement pitch of the electrodes 111*b* and 121*d*. In this manner, the conductive pieces 51 are alternately attached to the predetermined positions of the insulating block 52 at once. This step is repeated twice. A predetermined number of conductive pieces 51 are attached to the insulating block 52.

A case wherein a pair of projection portions 51*c* are arranged on both sides of each conductive piece 51 is described above. However, when the projection portion 51*c* is formed on one side of each conductive piece 51, the arrangement pitch p of the plurality of conductive pieces 51 formed on the connection member 51' may be equal to the arrangement pitch of the electrodes 111*b* and 121*d*. In this manner, a predetermined number of conductive pieces 51 can be attached to the insulating block 52 by performing the step once.

Figure 8A:
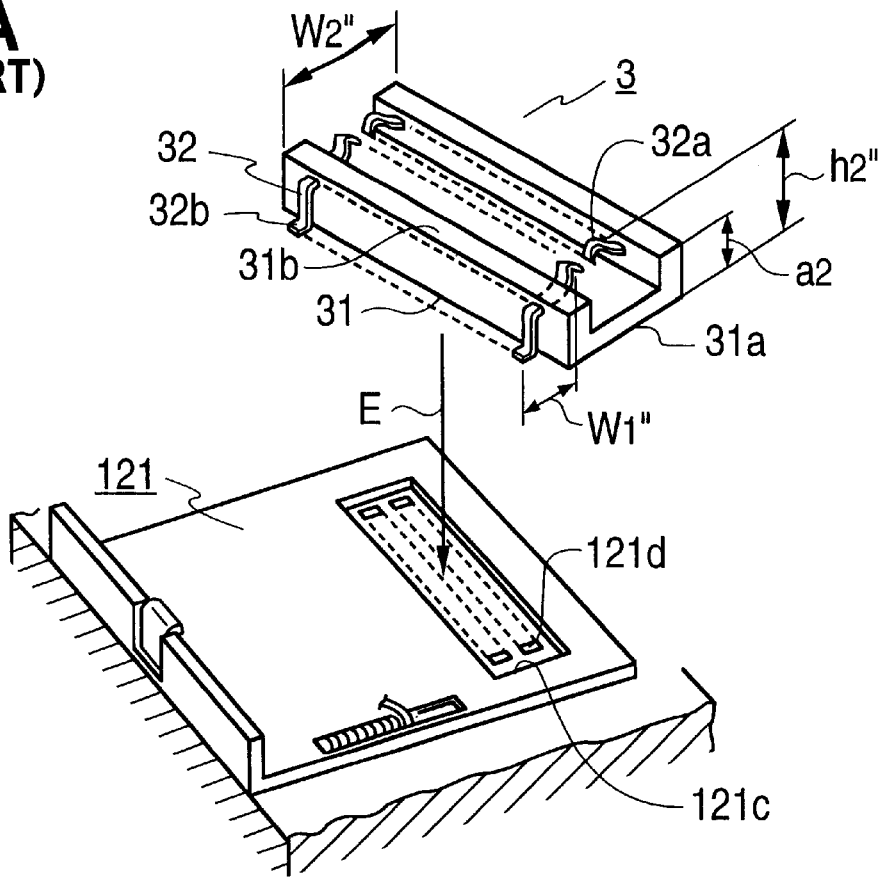
FIG. 8A (PRIOR ART)
FIGS. 8A and 8B are perspective views for explaining the structure of another conventional IC card connector.
Figure 8B:
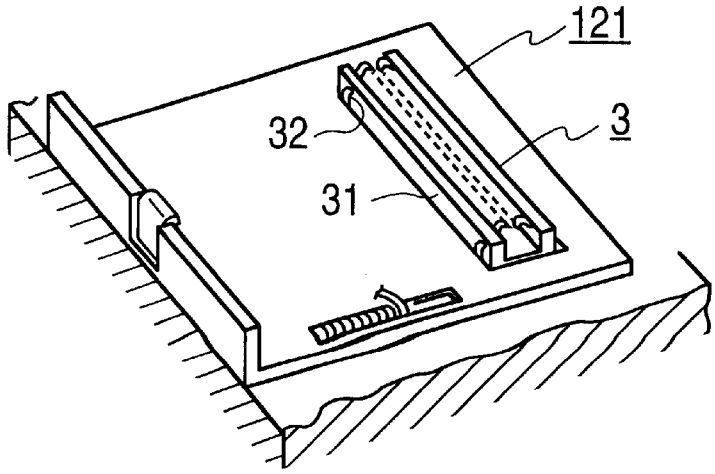
FIG. 8B (PRIOR ART)

In the connector 5 according to the present invention, the end portion of the second contact portion 51*d* of the conductive piece 51 projecting from the upper surface 52*e* of the insulating block 52 corresponds to the top of the inverted-U shape of the contact 32*a* of the conventional connector 3 shown in FIGS. 8A and 8B, and the first contact portion 51*a* curved on the lower surface 52*f* side of the insulating block 52 is located almost immediately below the second groove 52*d*. Therefore, by pressing force (see FIG. 1) indicated by arrows K and acting on the end portion of the second conduct portion 51*d*, the first contact portion 51*a* and the connection electrodes 121*d* (see FIG. 6) of the reception apparatus 12 are electrically connected.

Figure 5A:
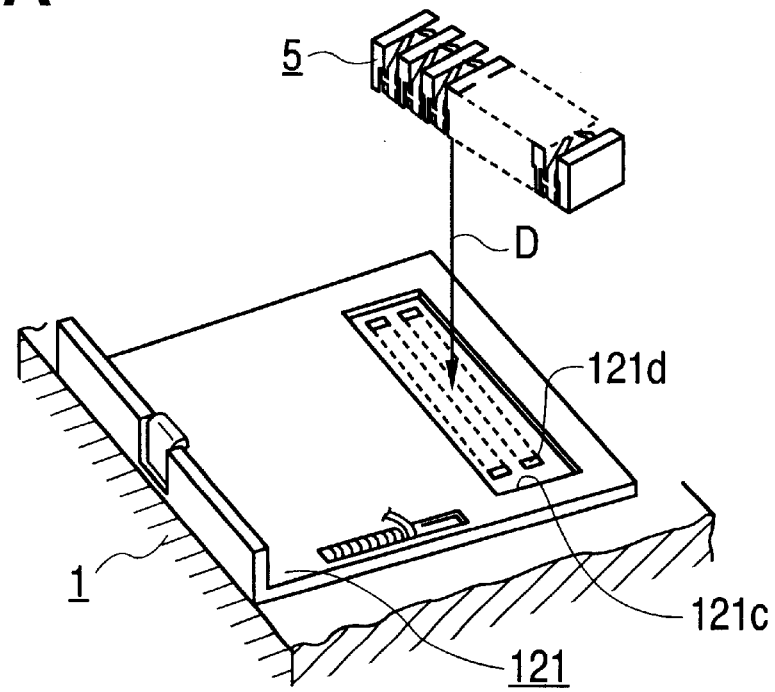
FIGS. 5A and 5B are partially exploded perspective views for explaining the connector according to the present invention together with a reception apparatus 12 to which an IC card connector is to be mounted.
Figure 5B:
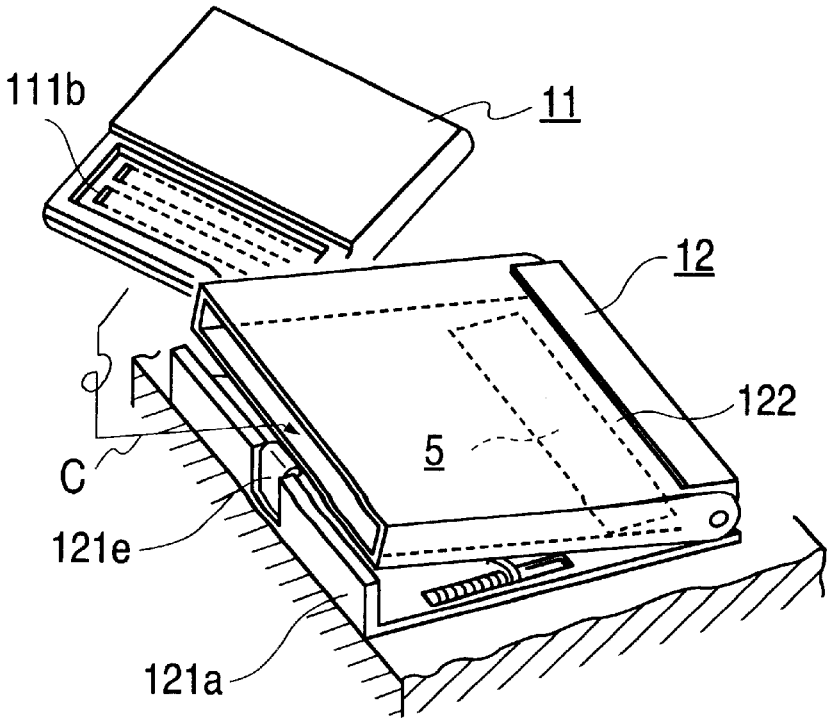

FIGS. 5A and 5B are perspective views for explaining an operation of attaching the connector 5 according to the present invention to the reception apparatus 12 as an IC card connector.

The connector 5 described with reference to FIGS. 1 to 4 is fitted in the opening 121*c* formed in the baseboard 121 of the reception apparatus 12 from the direction indicated by arrow D in FIG. 5A. In this manner, the first contact portion 51*a* (not shown) of the connector 5 is in contact with the connection electrode 121*d* on the baseboard 121 side. The IC card is inserted into the magazine 122 from the direction indicated by arrow C in FIG. 5B, and the magazine 122 is closed. More specifically, the magazine 122 is locked by the hook 121*e* arranged on the vertical wall 121*a* of the baseboard 121 of the reception apparatus 12. In this state, the second contact portion 51*d* of the connector 5 is elastically deformed by the information input/output electrodes 111*b* of the IC card 11. By the elastic force, a reliable electric connection between the end portions of the second contact portions 51*d* and the information input/output electrodes 111*b* is achieved. At the same time, by the elastic force, reliable electric connection between the first contact portions 51*a* and the connection electrodes 121*d* on the reception apparatus 12 side can be achieved, and soldering which is required in the prior art is not required.

As described above, according to the present invention, there is provided a connector and an IC connector which assure reliable and stable electric connection between the IC card 11 and the information input/output unit and is freely attached to or detached from a space between the IC card 11 and the information input/output unit.

The above embodiment describes a case wherein the first connect portions of the connector 5 and the connection electrodes 121*d* on the reception unit 12 side are connected to each other by contact obtained by mechanical pressure force. However, like the conventional connector 3 shown in FIG. 8, the connector 5 can also be connected to the connection electrodes 121*d* on the reception apparatus 12 side by soldering if necessary.

What is claimed is:

1. A connector insertable in a space between a first array of a plurality of first electrodes and a second array of a plurality of second electrodes, each of the second electrodes opposing one of the first electrodes in a non-contact state to form a plurality of pairs of electrodes, for connecting the first electrodes to the corresponding second electrodes, respectively, and selectively removable from the space between the first and second arrays, said connector comprising:

an insulating block having an upper surface and a lower surface which respectively oppose the first and second arrays when the connector is inserted therebetween and a pair of opposite side surfaces connecting the upper surface and the lower surface, a plurality of notched portions formed in each of the pair of side surfaces, each of the notched portions corresponding to an individual pair of the first and second electrodes and having a bottom surface connected with the lower surface, and a plurality of grooves formed in the upper surface, each groove having a bottom surface crossing a respective notched portion;

a plurality of conductive pieces, each corresponding to a respective pair of the first and second electrodes and each said conductive piece having a central portion fixed to said insulating block in the notched portion, a first contact portion extending from the central portion in a first direction and being bent so as to extend along the bottom surface, and a second contact portion extending from the central portion in a second direction opposite to the first direction, within the groove and toward the upper surface of the insulating block, the second contact portion including an end protruding resiliently above the upper surface when said connector is removed from the space between the first and second arrays;

a pair of projection portions which are disposed on the central portion of each of the conductive pieces and are perpendicular to the side surface of said insulating block; and holes in each of the notched portions, receiving the projection portions of the corresponding conductive piece and fixing the conductive pieces to said insulating block.

2. A connector according to claim 1, wherein each of the plurality of grooves corresponds to one of the plurality of notched portions and extends so as to cross the side surface.

3. A connector according to claim 1, wherein each of the notched portions formed in one of the side surfaces faces one of the notched portions formed in an opposite one of said side surfaces.

4. A connector according to claim 1, wherein the first contact portion protrudes from the lower surface when said connector is removed from space between the first and second arrays.

5. An IC card connector constituted by a connector insertable in a space between a first array of a plurality of first electrodes and a second array of a plurality of second electrodes, each of the second electrodes opposing one of the first electrodes in a non-contact state to form a plurality of pairs of electrodes, the inserted connector connecting the first electrodes to the corresponding second electrodes, respectively, and being selectively removable from the space between the first and second arrays, said connector comprising:

an insulating block having an upper surface and a lower surface which respectively oppose the first and second arrays when the connector is inserted therebetween, and a side surface connecting the upper surface and the lower surface, a plurality of notched portions formed in the side surface, each of the notched portions corresponding to an individual pair of the first and second electrodes and having a bottom surface connected with the lower surface, and a plurality of grooves formed in the upper surface, each groove having a bottom surface crossing a respective notched portion;

a plurality of conductive pieces, each corresponding to a respective pair of the first electrodes and one of the second electrodes, each said conductive piece having a central portion fixed to said insulating block in the notched portion, a first contact portion extending from the central portion in a first direction and being bent so as to extend along the bottom surface, and a second contact portion extending from the central portion in a second direction, opposite to the first direction, within the groove and toward the upper surface of the insulating block, the second contact portion including an end protruding resiliently from the upper surface when said connector is removed from the space between the first and second arrays;

a pair of projection portions which are disposed on the central portion of each of the conductive pieces and are perpendicular to the side surface of said insulating block; and holes in each of the notched portions, receiving the projection portions of the corresponding conductive piece and fixing the conductive pieces to said insulating block, wherein, in order to connect an IC card, having a vertical wall for positioning said IC card and having a plurality of information input/output electrodes, to an IC card information input/output unit, having a plurality of connection electrodes respectively formed at positions corresponding to the information input/output electrodes of said IC card positioned by the vertical wall, said IC card is inserted between the information input/output electrodes and the connection electrodes, and the second contact portions are brought into contact with the information input/output electrodes of said IC card positioned by the vertical wall, and the first contact portions are brought into contact with the connection electrodes of said IC card information input/output unit.

6. A connector to connect opposing pluralities of electrodes, said connector comprising:

an insulating block having upper and lower surfaces and opposite side surfaces extending between the upper and lower surfaces, a plurality of grooves formed therein from the upper surface and extending between the opposite side surfaces of the insulating block, with notched portions in one of the side walls, formed proximate said grooves, each said notched portion including a pair of holes and a lower recessed surface in the lower surface of the insulating block; and a plurality of conductive pieces received in respective notches, each said conductive piece including a central portion and, extending therefrom, a first contact portion that protrudes from said lower recessed surface and contacts one of said opposing electrodes, projection portions engaging said holes to hold said conductive piece to said insulating block, and a second contact portion disposed in said proximate, respective groove and protruding resiliently from the upper surface of said insulation block to contact the other of said opposing electrodes; wherein said projection portions are disposed on the central portion of each of the conductive pieces and are perpendicular to a corresponding said side surface of said insulating block.

7. An electrical connector for connecting a first plurality of electrodes with a second plurality of electrodes, said first plurality of electrodes being spaced from the second plurality of electrodes by a space therebetween, said connector comprising:

an insulating block having upper and lower surfaces and opposite side surfaces interconnecting the upper and lower surfaces;

a plurality of notches formed in at least one of the opposite side surfaces; and a plurality of bent connector elements, each of said bent connector elements being received in a respective one of said notches and having a pair of extensions, respectively projecting from opposite lateral sides of said bent elements, with said extensions fitting into corresponding holes formed in the respective notch and holding the bent connector element in position in the respective notch, each bent connector element including a first contact portion exposed at the bottom surface of the insulating block and a second contact portion resiliently protruding from the upper surface of the insulating block.

8. An electrical connector insertable into a space between a first array of plural first electrodes and a second array of second plural second electrodes, related as plural pairs of respective first and second electrodes spaced at a common pitch, for individually interconnecting each of said plural pairs of respectively first and second electrodes, the electrical connector comprising:

an insulating block elongated in a first direction and having parallel first and second main surfaces, spaced apart by a distance corresponding substantially to the distance between the first and second arrays of electrodes, and first and second parallel side surfaces, transverse to and extending in a second direction between respective edges of the first and second parallel main surfaces, plural notches in at least one of the first and second parallel side surfaces extending in a second direction perpendicular to the first direction and spaced at the common pitch in the first direction and plural grooves extending into the insulating block from the first main surface, perpendicular to the first direction and spaced at the common pitch in the first direction and aligned with the plural notches, each groove intersecting a respective notch and together therewith providing a connector element mount; and plural connector elements carried by the insulating block in the plural connector element mounts, respectively, and corresponding to the plural pairs of first and second electrodes, each connector element being formed of a sheet of conductive resilient material and having a unitary structure of a central portion, a first contact element bent relatively to, and extending from a first end of the central portion at an acuate angle and a second contact element bent relatively to, and extending from, a second end of the central portion at substantially a right angle, the connector element being received on the respective connector element mount with the central portion engaged to the notch, the first contact element extending through the groove and resiliently protruding from the first main surface of the insulating block and the second contact element being exposed on and extending along the second main surface of the insulating block.

9. An electrical connector according to claim 8, wherein:

the first and second parallel side surfaces of the insulating block have respective, plural notches therein spaced at a common pitch in the first direction and commonly intersected by the plural grooves, respectively, so as to define aligned, plural connector element mounts respectively in the first and second parallel side surfaces; and plural connector elements are received respectively in the plural connector element mounts of the first and second parallel side surfaces in spaced, non-contacting relationship.

10. An electrical connector according to claim 8, wherein the central portion of each connector element further comprises a pair of extensions projecting from opposite edges of the central portion and received in corresponding holes in the notch of the respective connector element mount thereby securing the connector element in the respective connector element mount.

11. An electrical connector according to claim 8, wherein the insulating block further comprises plural grooves in the second main surface respectively corresponding to and receiving therein the second contact elements of the respective connector elements.

* * * * *